US007288883B2

(12) United States Patent
Ji et al.

(10) Patent No.: US 7,288,883 B2
(45) Date of Patent: Oct. 30, 2007

(54) FLAT PANEL DISPLAY DEVICE WITH REDUCED ALIGNMENT ERROR

(75) Inventors: Kwang-Sun Ji, Suwon-si (KR); Eung-Joon Chi, Suwon-si (KR); Sung-Hwan Jin, Suwon-si (JP)

(73) Assignee: Samsung SDI Co., Ltd, Suwon-si (KR)

( * ) Notice: Subject to any disclaimer, the term of this patent is extended or adjusted under 35 U.S.C. 154(b) by 0 days.

(21) Appl. No.: 10/969,432

(22) Filed: Oct. 19, 2004

(65) Prior Publication Data

US 2005/0110391 A1 May 26, 2005

(30) Foreign Application Priority Data

Nov. 26, 2003 (KR) ..... 10-2003-0084487
Jan. 30, 2004 (KR) ..... 10-2004-0005979

(51) Int. Cl.
*H01J 63/04* (2006.01)

(52) U.S. Cl. ..... 313/495; 313/496; 313/497; 313/309; 313/512

(58) Field of Classification Search ..... 313/495, 313/497, 496, 283, 292, 293, 309; 427/77
See application file for complete search history.

(56) References Cited

U.S. PATENT DOCUMENTS 5,506,467 A * 4/1996 Nishimura et al. ..... 313/408
5,589,731 A * 12/1996 Fahlen et al. ..... 313/495
5,864,205 A * 1/1999 Dworsky ..... 313/495
6,252,347 B1 * 6/2001 Breen et al. ..... 313/495
6,471,525 B1 * 10/2002 Fan et al. ..... 439/70
2002/0041155 A1 * 4/2002 Asami et al. ..... 313/583
2003/0214226 A1 * 11/2003 Lee et al. ..... 313/495
2004/0007965 A1 * 1/2004 Kijima et al. ..... 313/495
2004/0104667 A1 * 6/2004 Russ et al. ..... 313/495

* cited by examiner

*Primary Examiner*—Joseph Williams
*Assistant Examiner*—Hana Asmat Sanei
(74) *Attorney, Agent, or Firm*—Christie, Parker & Hale, LLP

(57) ABSTRACT

Disclosed is a flat panel display device for preventing a grid electrode from causing alignment error and being distorted due to thermal expansion and contraction. The grid electrode includes a mask portion with apertures through which electrons may pass, and fixtures arranged external to the mask portion with a predetermined margin for allowing thermal expansion and contraction of the mask portion. The fixtures are arranged symmetrical to each other up and down as well as left and right. The fixtures fix the mask portion such that the expansion and the extraction of the mask portion proceed opposite to one another.

10 Claims, 8 Drawing Sheets

FLAT PANEL DISPLAY DEVICE WITH REDUCED ALIGNMENT ERROR

CROSS-REFERENCE TO RELATED APPLICATIONS

This application claims the benefit of and priority to Korean Patent Application No. 2003-0084487, filed on Nov. 26, 2003 and Korean Patent Application No. 2004-0005979, filed on Jan. 30, 2004, the entire disclosures of which are incorporated herein by reference.

BACKGROUND OF THE INVENTION (a) Field of the Invention

The present invention relates to a flat panel display device, and in particular, to a flat panel display device which has a grid electrode with minimized distortion and alignment error.

(b) Description of Related Art

A flat panel display device includes an electron emission device which is a vacuum vessel with first and second substrates, electron emission sources provided at the first substrate and phosphor layers provided at the second substrate. Electrons are emitted from the electron emission sources to excite the phosphor layers. With the electron emission device, either hot cathodes or cold cathodes may be used as the electron emission sources. Among the cold cathode electron emission devices are field emitter array (FEA) types, surface conduction electron-emitter (SCE) types, and metal-insulator-metal (MIM) types.

In a typical electron emission device, a rear substrate with the electron emission source and driving electrodes, and a front substrate with an accelerating electrode (or anode electrode) and phosphor layers are sealed to one another by a frit seal to form a vacuum vessel. A plurality of spacers are typically mounted within the vacuum vessel to space the front and the rear substrates apart from each other by a predetermined distance.

A metal mesh type grid electrode with a plurality of apertures is placed between the front and the rear substrates. The grid electrode focuses the electrons emitted from the electron emission sources to enhance the color purity of the display screen, and heightens the voltage resistance characteristics between the driving electrodes on the rear substrate and the anode electrode.

The metal-based grid electrode has a thermal expansion coefficient that is very different from the glass-based front and rear substrates. Consequently, during the thermal treatment process, such as sealing, the grid electrode is easily distorted or misaligned due to the thermal stress applied to the grid electrode.

The alignment error of the grid electrode results in deteriorated display characteristics. That is, the electrons emitted from the electron emission sources do not pass through the relevant pixel apertures, but collide against the grid electrode and scatter, or pass through the incorrect pixel apertures, and land on the phosphor layers at the incorrect pixels. Furthermore, the distortion of the grid electrode can sometimes result in contact between the grid electrode and the electron emission sources, thereby causing an electrical short circuit.

Moreover, as the grid terminal for applying electrical signals to the grid electrode is often connected to the grid electrode by a simple band or a wire while being sealed thereto by a sealant, the grid terminal tends to be restrained against thermal expansion and contraction which can worsen the alignment error.

SUMMARY OF THE INVENTION

In one exemplary embodiment of the present invention, there is provided a flat panel display device which helps to minimize grid electrode alignment errors so that the electrons emitted from the electron emission sources wholly pass through the relevant pixel apertures, thereby improving the display characteristics. Furthermore, by minimizing the grid electrode alignment errors, the grid electrode is prevented from being distorted, thereby preventing electrical short circuits due to the contacting between the grid electrode and the electron emission sources.

In an exemplary embodiment of the present invention, a flat panel display device includes first and second substrates facing each other and separated by a given distance. The first and the second substrates are sealed to each other by a sealant to form a vacuum vessel. Electron emission sources are arranged at the first substrate. A light emission unit is formed at the second substrate. A grid electrode is disposed between the first and the second substrates to control the focusing of the electrons. The grid electrode has a mask portion with apertures through which the electrons pass. Fixtures are arranged external to the mask portion symmetrical to each other up and down as well as left to right with a predetermined margin for allowing the thermal expansion of the mask portion. The fixtures fix the mask portion such that the expansion and the extraction of the mask portion proceed opposite to each other.

In this embodiment, the fixtures have fixation frames externally attached to the mask portion, and fixation pieces penetrating the respective fixation frames, and placed between the first and second substrates. Pairs of first and second fixation frames are provided at both ends of each of the long sides of the mask portion, and a pair of third fixation frames are provided at the centers of the long sides of the mask portion.

In this embodiment, the fixation pieces placed within the respective fixation frames are spaced apart from the mask portion by a predetermined distance forming a first gap in the direction of the short axis of the grid electrode. The fixation pieces placed within the first and the second fixation frames have a lateral side directed toward the third fixation frame, and are spaced apart from the relevant fixation frame by a predetermined distance to form a second gap in the direction of the long axis of the grid electrode.

In this embodiment, the fixation pieces placed within the third fixation frame have lateral sides directed toward the first and the second fixation frames, and are spaced apart from the third fixation frame by a predetermined distance to form a third gap in the direction of the long axis of the grid electrode. Alternatively, the lateral sides of the fixation frame pieces may contact the third fixation frame.

The fixation frame pieces are preferably formed of glass to minimize the difference thereof between the thermal expansion coefficient from the first and the second substrates. The fixation pieces have a height identical with or smaller than the distance between the first and the second substrates such that the first and the second substrates do not loosen at the area of the fixation pieces.

The grid electrode further includes a non-effective portion surrounding the mask portion. Therefore, the fixtures have fixation holes formed at the non-effective portion external to the mask portion, and fixation pieces pass through the respective fixation holes, and are placed between the first and the second substrates.

The grid electrode further has a grid terminal that passes through the sealant to apply electrical signals to the grid electrode. Each grid terminal has a variable length portion placed internal to the sealant with a predetermined elasticity, or a variable thickness portion formed at the end portion thereof with a predetermined elasticity. In the latter case, the grid terminal contacts the grid electrode via the variable thickness portion.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION

The present invention will be described more fully hereinafter with reference to the accompanying drawings, in which preferred embodiments of the invention are shown.

Figure 1:
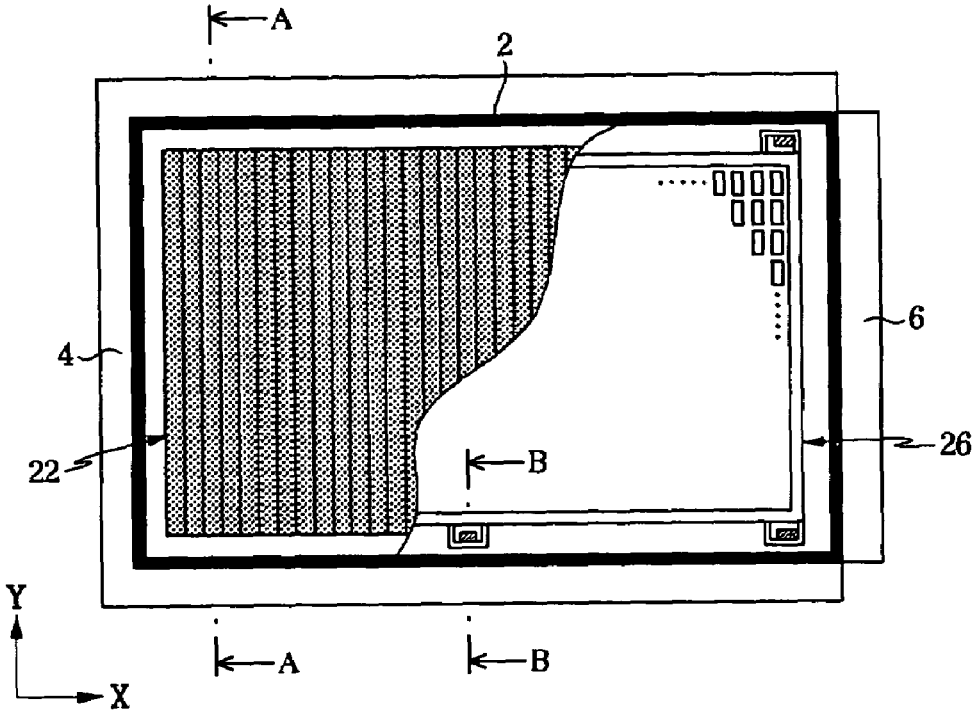
FIG. 1 is a plan view of a flat panel display device with a grid electrode according to an embodiment of the present invention.
Figure 2:
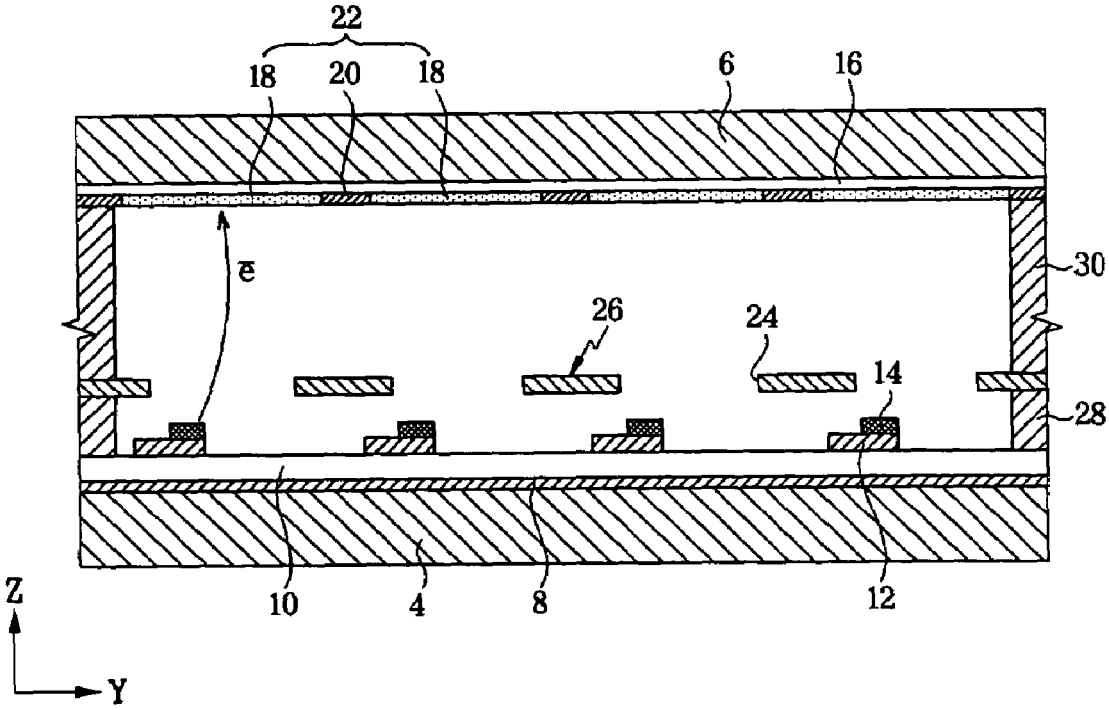
FIG. 2 is a partial sectional view of the flat panel display device taken along the A-A line of FIG. 1.

FIG. 1 is a plan view of a flat panel display device according to an embodiment of the present invention, and FIG. 2 is a partial sectional view of the flat panel display device taken along the A-A line of FIG. 1.

As shown in the drawings, the flat panel display device includes first and second substrates 4 and 6 sealed to each other at their peripheries by a frit seal 2 to form a vacuum vessel. An electron emission source at the first substrate 4 emits electrons that impinge the second substrate 6 to form the desired visible images.

The electron emission structure will be now explained with reference to a field emitter array (FEA) typed electron emission device. The electron emission structure may be altered in various manners provided that it belongs to the FEA type.

Specifically, gate electrodes 8 are formed on the first substrate 4 with a stripe pattern proceeding in one direction (in the Y direction of the drawing), and an insulating layer 10 is internally formed on the entire surface of the first substrate 4 while covering the gate electrodes 8. Cathode electrodes 12 are formed on the insulating layer 10 with a stripe pattern perpendicular to the gate electrodes 8 (in the X direction of the drawing).

The pixel regions of the flat panel display device are defined by the regions where the gate electrodes 8 and the cathode electrodes 12 cross each other. Electron emission regions 14 are placed at one-sided of the cathode electrode 12, per the respective pixel regions. The electron emission region 14 is preferably formed with a carbon-based material, such as carbon nanotube, graphite, diamond, diamond-like carbon, fulleren ($C_{60}$), or mixtures thereof. Also the electron emission region 14 may be formed with a nanometer-sized material, such as carbon nanotube, graphite nanofiber, or silicon nanowire.

As described above, the gate electrodes 8 are placed under the cathode electrodes 12 separated by the insulating layer 10. Alternatively, although not shown in the drawings, the gate electrodes may be placed over the cathode electrodes separated by the insulating layer. In this case, a hole is formed at the gate electrode and the insulating layer at the crossed region of the cathode and the gate electrodes, and an electron emitter is formed on the cathode electrode exposed through the hole.

An anode electrode 16 is formed on the surface of the second substrate 6 facing the first substrate 4. A phosphor screen 22 is formed on the anode electrode 16 with red, green and blue phosphor layers 18 and a dark layer 20. The anode electrode 16 is formed with a transparent conductive material, such as ITO. Meanwhile, a metallic layer (not shown) may be formed on the phosphor screen 22 to enhance the screen brightness due to the metal back effect thereof. In this case, the transparent anode electrode 16 may be omitted while using the metallic layer as an anode electrode.

When a predetermined driving voltage is applied to the gate electrode 8 and the cathode electrode 12, an electric field is formed around the electron emission region 14 due to the voltage difference between the two electrodes, and electrons are emitted from the electron emission region 14. When a high positive (+) voltage is applied to the anode electrode 16, the electrons emitted from the electron emission region 14 land on the phosphor layers 18 to excite them and produce the desired visible screen images.

A metal mesh-shaped grid electrode 26 is positioned within the vacuum vessel formed by the first and the second substrates 4 and 6 with a plurality of apertures 24 through which electrons may pass. For example, a positive (+) voltage lower than the anode voltage is applied to the grid electrode 26, to focus the electrons emitted from the electron emission regions 14 and heighten the color purity of the display screen.

A plurality of lower spacers 28 are arranged between the first substrate 4 and the grid electrode 26 to maintain the distance thereof in a stable manner. A plurality of upper spacers 30 are arranged between the grid electrode 26 and the second substrate 6 to maintain the distance thereof in a stable manner.

Moreover, in this embodiment, the grid electrode 26 is fixed to the first and the second substrates 4 and 6 in an improved way to prevent alignment errors of the grid electrode, or distortion caused by its coefficient of thermal expansion being different from that of the first and the second substrates 4 and 6.

Figure 3:
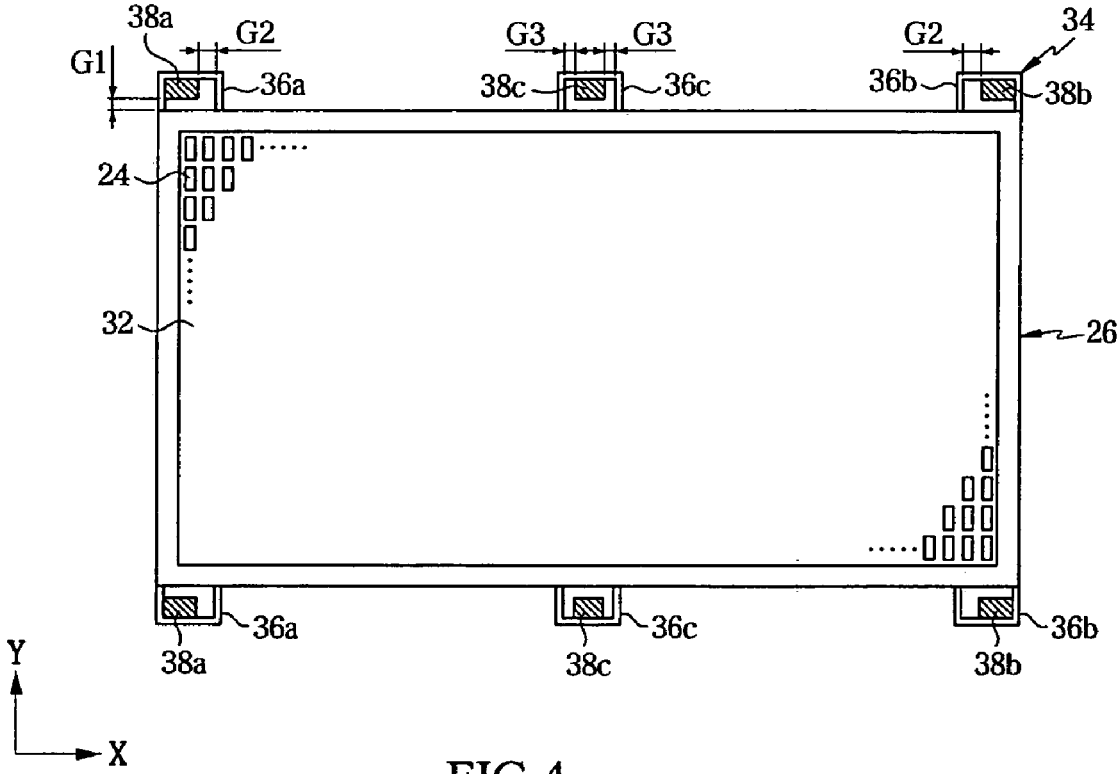
FIG. 3 is a plan view of a first variant of the grid electrode.
Figure 4:
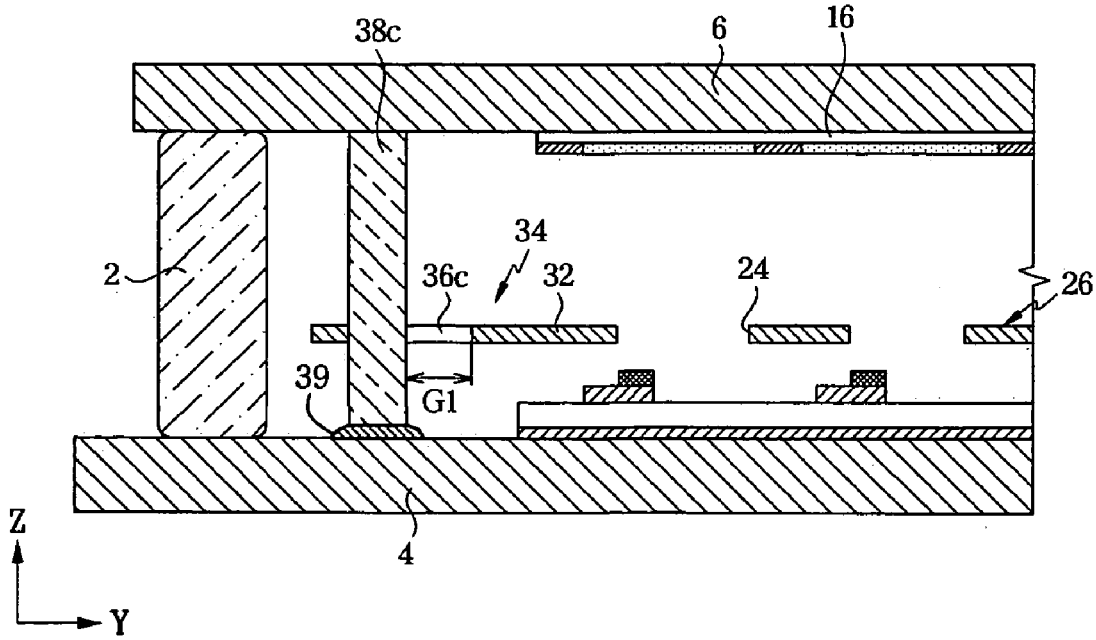
FIG. 4 is a partial sectional view of the flat panel display device taken along the B-B line of FIG. 1.

FIG. 3 is a plan view of a first variant of the grid electrode for a flat panel display device according to an embodiment of the present invention, and FIG. 4 is a partial sectional view of the flat panel display device of FIG. 1 taken along line B-B.

As shown in the drawings, the grid electrode 26 has a mask portion 32 with a plurality of apertures 24, and fixtures 34 arranged external to the mask portion 32 with a predetermined margin for allowing the thermal expansion of the mask portion 32. the fixtures are symmetrical to each other up and down as well as left and right. The fixtures 34 fix the mask portion 32 such that the expansion and the contraction thereof proceed opposite to each other.

Each of the fixtures 34 includes a fixation frame 36*a*, 36*b* and 36*c*, and a fixation piece 38*a*, 38*b* and 38*c* placed within the corresponding fixation frame 36*a*, 36*b* and 36*c* to fix the mask portion 32 to the first and the second substrates 4 and 6.

The fixation frames include pairs of first and second fixation frames 36*a* and 36*b* placed at the left and right corners of the mask portion 32, and a pair of third fixation frames 36*c* placed at the upper and lower centers thereof. Six fixation frames 36*a*, 36*b* and 36*c* are provided over the entire area of the grid electrode 26 with pairs of fixation frames symmetrical to one another.

Six fixation pieces 38*a*, 38*b* and 38*c* are placed within the respective fixation frames. The respective fixation pieces within the fixation frames are spaced apart from the mask portion 32 by a predetermined distance. A first gap G1 is made between the fixation pieces and the mask portion in the direction of the short axis of the grid electrode 26 (in the Y-direction of the drawing).

Each of the first and the second fixation pieces 38*a* and 38*b* is placed within the corresponding of the first and the second fixation frames 36*a* and 36*b* and has a lateral side directed toward the third fixation frame 36*c* while being spaced apart from the relevant fixation frame by a predetermined distance. That is, a second gap G2 is made between the fixation pieces and the fixation frames in the direction of the long axis of the grid electrode 26 (in the X-direction of the drawing). Each of the third fixation pieces 38*c* is placed within the corresponding third fixation frame 36*c* and has lateral sides directed toward the corresponding first and the second fixation frames 36*a* and 36*b* while being spaced apart from the relevant fixation frame by a predetermined distance. That is, a third gap G3 is made between the fixation pieces and the fixation frames in the direction of the long axis of the grid electrode 26.

The margins of the first and the second fixation pieces 38*a* and 38*b* in the direction of the long axis of the grid electrode 26 have the same dimension as the second gap G2, and the left and right margins of the third fixation pieces 38*c* in the long axial direction have the same dimension as the third gap G3. In this way, the fixation frames 36*a*, 36*b* and 36*c* as well as the fixation pieces 38*a*, 38*b* and 38*c* are mounted over the entire area of the grid electrode 26, symmetrical to each other up and down as well as left and right.

Moreover, in one embodiment, the respective fixation pieces 38*a*, 38*b* and 38*c* are formed with a material having a coefficient of thermal expansion identical with or similar to the first and the second substrates 4 and 6 which are typically formed of a material such as glass. This helps to minimize the difference in the coefficient of thermal expansion between the fixation pieces 38*a*, 38*b* and 38*c* and the first and second substrates 4 and 6. The height of the respective fixation pieces 38*a*, 38*b* and 38*c* is identical with or smaller than the distance between the first and the second substrates 4 and 6 to prevent the first and the second substrates 4 and 6 from loosening at the fixation pieces 38*a*, 38*b* and 38*c*. According to this embodiment, the above-structured grid electrode 26 is placed entirely internal to the sealant 2.

The above-structured grid electrode 26 is mounted on the first substrate 4 with the lower spacers 28, and aligned to the latter. The fixation pieces 38*a*, 38*b* and 38*c* are placed within the relevant fixation frames, and the bottom side thereof is attached to the first substrate 4 by an adhesive agent 39. Upper spacers 30 are mounted on the grid electrode 26. A sealant 2 is coated along the periphery of the first substrate 4, to seal the second substrate 6 to the first substrate 4. The inner space between the first and the second substrates 4 and 6 is evacuated through an exhaust (not shown) to thereby complete a vacuum vessel.

As the sealing is made at high temperature, the grid electrode 26 which is formed from a metallic material having a coefficient of thermal expansion larger than that of the first and the second substrates 4 and 6 is expanded during the thermal treatment process, and contracted at ambient temperature after the thermal treatment process is made.

Figure 5:
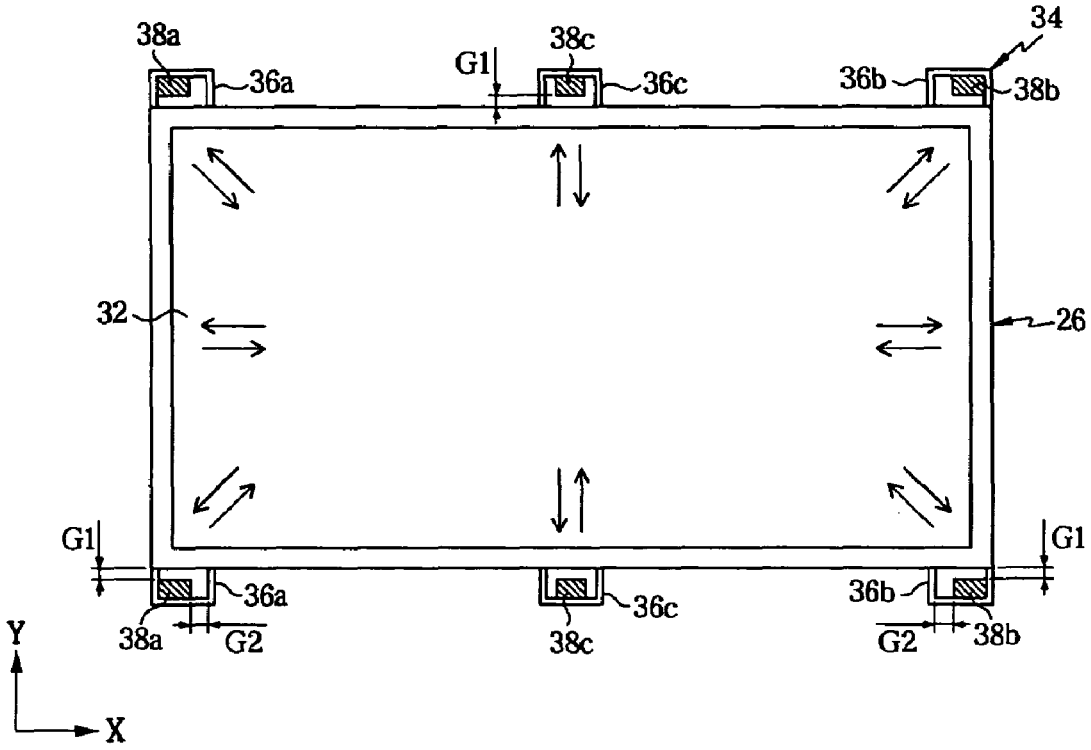
FIG. 5 is a plan view of the grid electrode shown in FIG. 3, illustrating the directions of expansion and contraction of a mask portion thereof before and after the thermal treatment process.

FIG. 5 is a schematic view of a grid electrode illustrating the directions of expansion and contraction of the mask portion. In the drawing, the direction of expansion and the direction of contraction are identified by solid lines and dotted lines, respectively.

As shown in FIG. 5, the mask portion 32 is externally expanded at high temperature. That is, the mask portion 32 around the first and the second fixation pieces 38*a* and 38*b* is expanded toward the first and the second fixation pieces 38*a* and 38*b* through the first and the second gaps G1 and G2 formed at the first and the second fixation pieces 38*a* and 38*b*. The mask portion 32 around the third fixation piece 38*c* is expanded toward the third fixation piece 38*c* through the first gap G1 formed at the third fixation piece 38*c*.

The thermally expanded mask portion 32 is contracted back to its original size after cooling to ambient temperature. With the outlining structure of the fixation frames 36*a*, 36*b* and 36*c* and the fixation pieces 38*a*, 38*b* and 38*c*, the contraction of the mask portion 32 proceeds opposite to the expansion thereof. Accordingly, the grid electrode 26 maintains its initial alignment state after the thermal expansion and the contraction of the mask portion 32 have occurred, and the alignment error and the distortion thereof are largely prevented.

Figure 6:
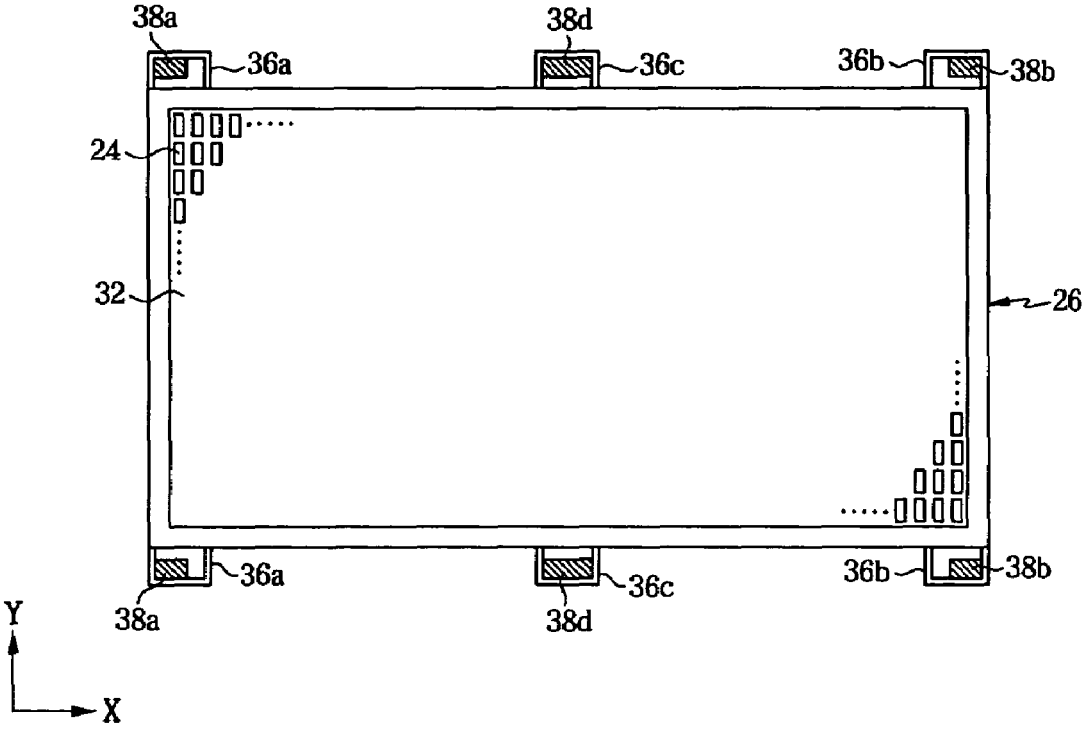
FIG. 6 is a plan view of a second variant of the grid electrode.

It has previously been explained that the third fixation piece 38*c* has lateral sides directed toward the first and the second frames 36*a* and 36*b* while being spaced apart from the relevant fixation frame with the third gap G3. Alternatively, as shown in FIG. 6 which illustrates a second variant of the grid electrode, the lateral sides of the third fixation piece 38*d* may all contact the third fixation frame 36*c* to fix the center of the mask portion 32. For this embodiment, because the thermal expansion and the contraction of the mask portion 32 are made while the center thereof is fixed, the wholesale displacement of the mask portion 32 is precluded. Therefore, even though an alignment error is made at the mask portion 32, it is localized at the outer periphery of the mask portion 32, and any deterioration in the screen image quality is minimized.

According to this embodiment, one or more fixation pieces 38*a*, 38*b* and 38*c* are provided in the respective fixation frames 36*a*, 36*b* and 36*c* such that the fixation pieces occupy 65-85% of the inner space of the respective fixation frames, thereby reinforcing the adhesive force of the fixation pieces. If the area occupied by each of the fixation pieces is less than 65% of the respective fixation frame, it is difficult to obtain sufficient reinforcing effect from the fixation pieces. If the area occupied by each of the fixation pieces exceed 85% of the respective fixation frame, there is insufficient room to accommodate the desired expansion and the contraction of the mask portion, and it becomes difficult to maintain the initial alignment state thereof.

Figure 7:
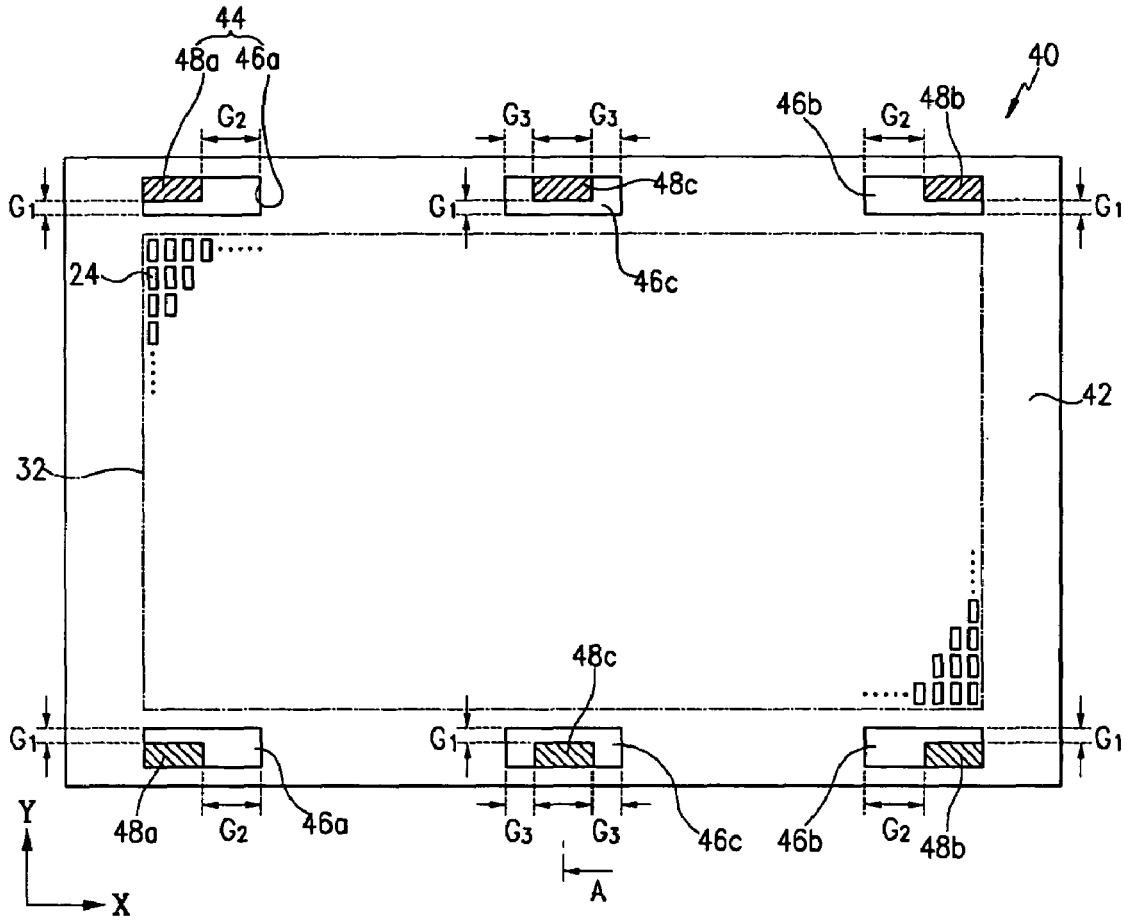
FIG. 7 is a plan view of a third variant of the grid electrode.

FIG. 7 is a plan view of a third variant of the grid electrode for a flat panel display device according to another embodiment of the present invention.

As shown in FIG. 7, the grid electrode 40 has a mask portion 32 with a plurality of apertures 24, and a non-effective portion 42 surrounding the mask portion 32. The fixtures 44 have pairs of fixation holes 46*a*, 46*b* and 46*c* arranged around the non-effective portion 42 of the grid electrode. A total of six symmetrical fixation holes are provided with a pair each of first and second fixation holes 46*a* and 46*b* provided at the left and the right longitudinal side ends of the mask portion 32, and a pair of third fixation holes 46*c* provided at the longitudinal side centers of the mask portion 32. Corresponding pairs of fixation pieces 48*a*, 48*b* and 48*c* are placed within the fixation holes 46*a*, 46*b* and 46*c*, respectively, to fix the grid electrode 40 to the first and the second substrates. The positional characteristic and functions of the fixation pieces 48*a*, 48*b* and 48*c* are the same as those related to the first embodiment, and hence, detailed explanation thereof will be omitted.

Figure 8:
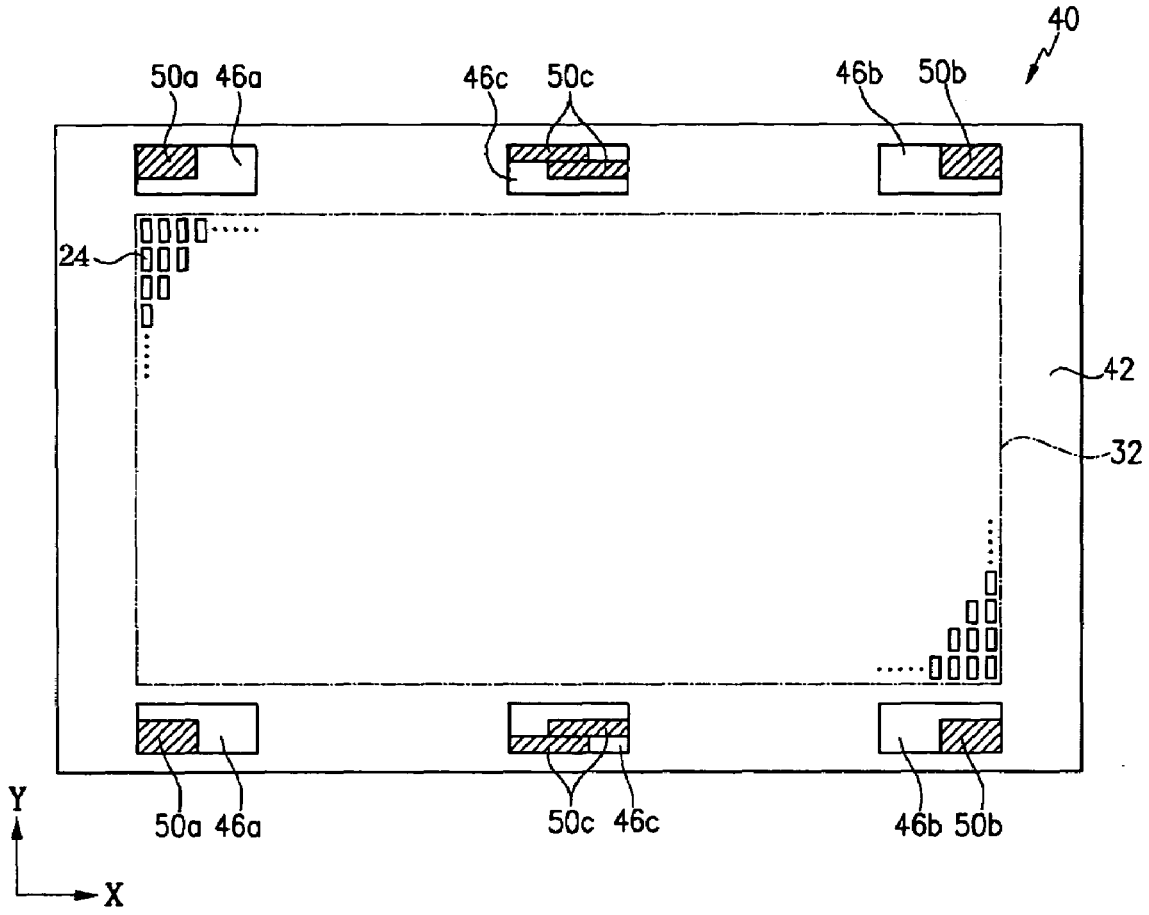
FIG. 8 is a plan view of a fourth variant of the grid electrode.
Figure 9:
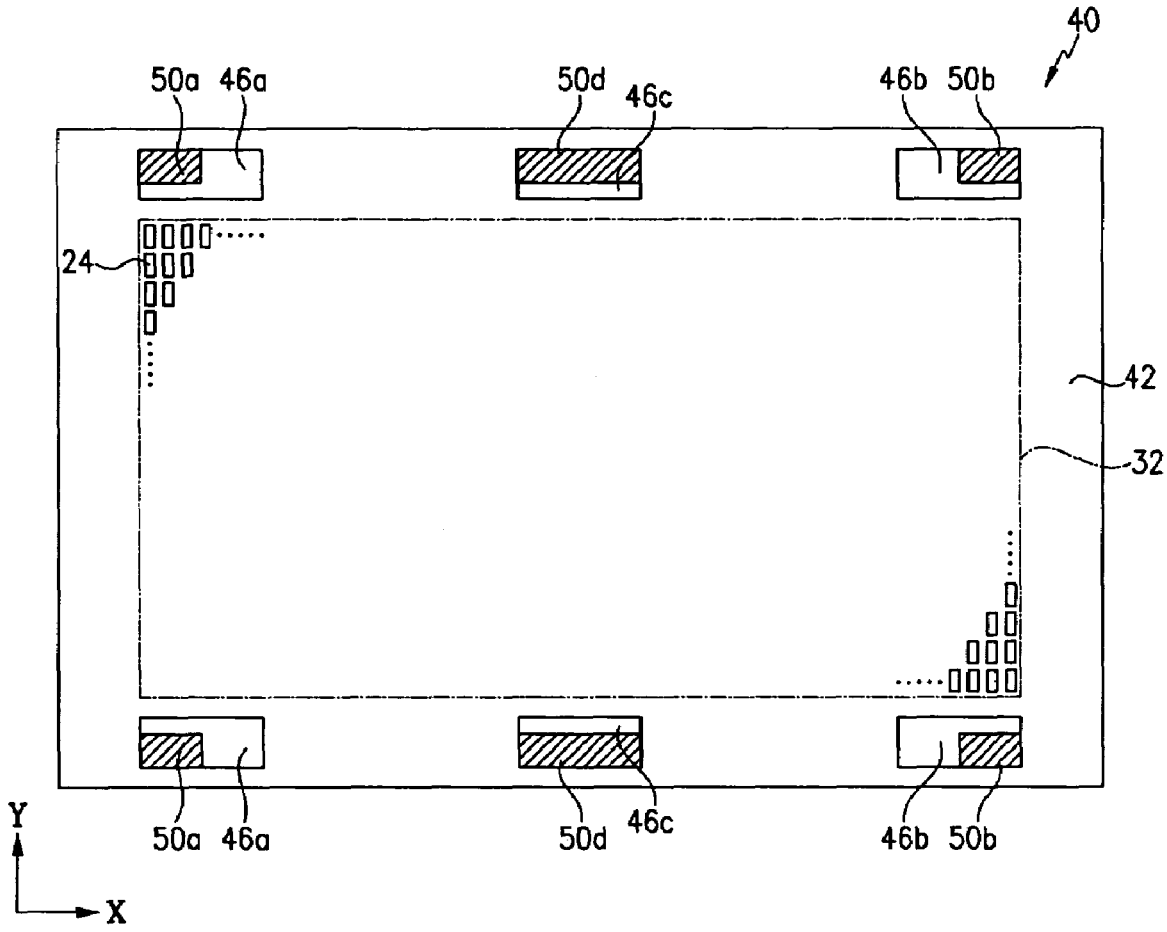
FIG. 9 is a plan view of a fifth variant of the grid electrode.

FIGS. 8 and 9 are plan views of fourth and fifth variants of the grid electrode for flat panel display devices according to still other embodiments of the present invention.

As shown in the drawings, pairs of fixation pieces 50*c* and 50*d* are placed within each of the pair of third fixation holes 46*c* and are fitted to the third fixation holes 46*c* at their both lateral ends to hold the center of the mask portion 32. For this purpose, as shown in FIG. 8, two fixation pieces 50*c* are provided at each of the third fixation holes 46*c* such that they are dislocated from each other. Alternatively, as shown in FIG. 9, one fixation piece 50*d* may be provided at each of the third fixation holes 46*c* such that it has the same horizontal length as that of the third fixation hole 46*c*.

Furthermore, as shown, the fixation pieces 50*a*, 50*b*, 50*c* and 50*d* occupy 65-85% of the internal area of the corresponding fixation holes 46*a*, 46*b* and 46*c* to reinforce the fixation of the grid electrode to the substrates. If the area occupied by each of the fixation pieces is less than 65% of the respective fixation frame, it is difficult to obtain sufficient reinforcing effect from the fixation pieces. If the area occupied by each of the fixation pieces exceed 85% of the respective fixation frame, there is insufficient room to accommodate the desired expansion and the contraction of the mask portion, and it becomes difficult to maintain the initial alignment state thereof.

Figure 10:
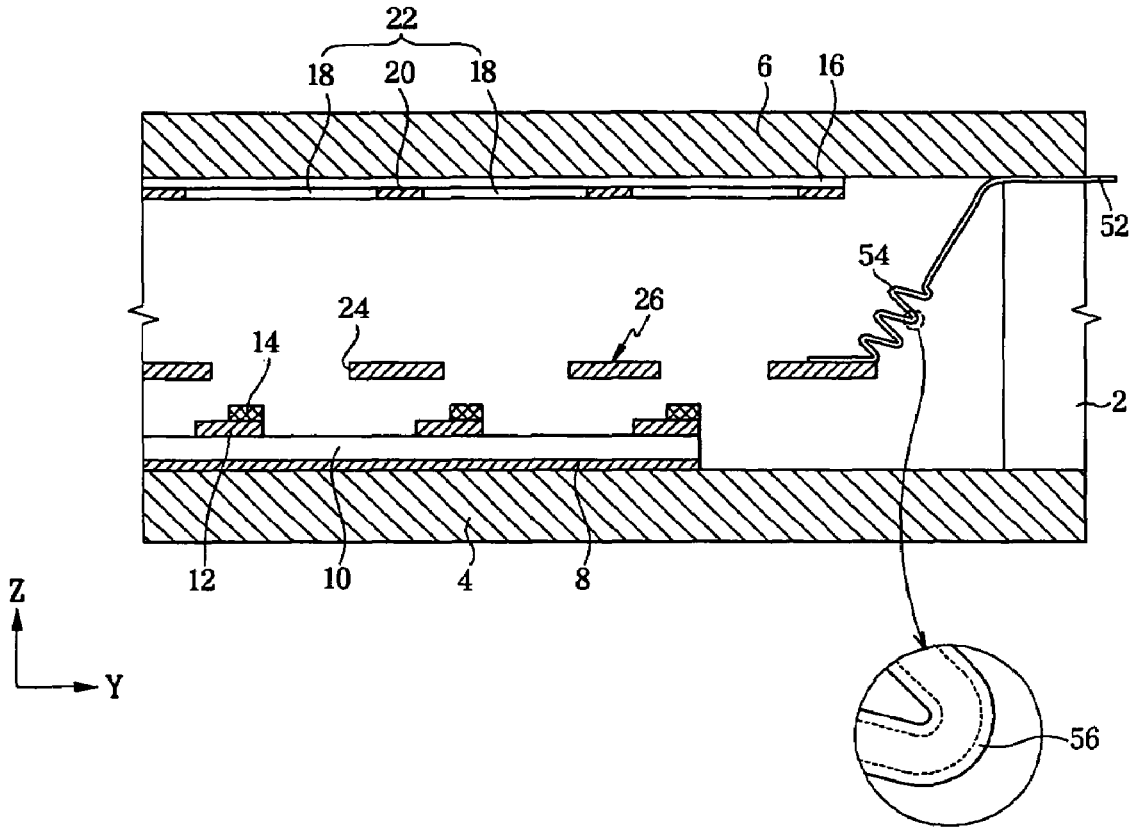
FIG. 10 is a partial sectional view of the flat panel display device according to an embodiment of the present invention in which a grid terminal is mounted at the grid electrode.
Figure 11:
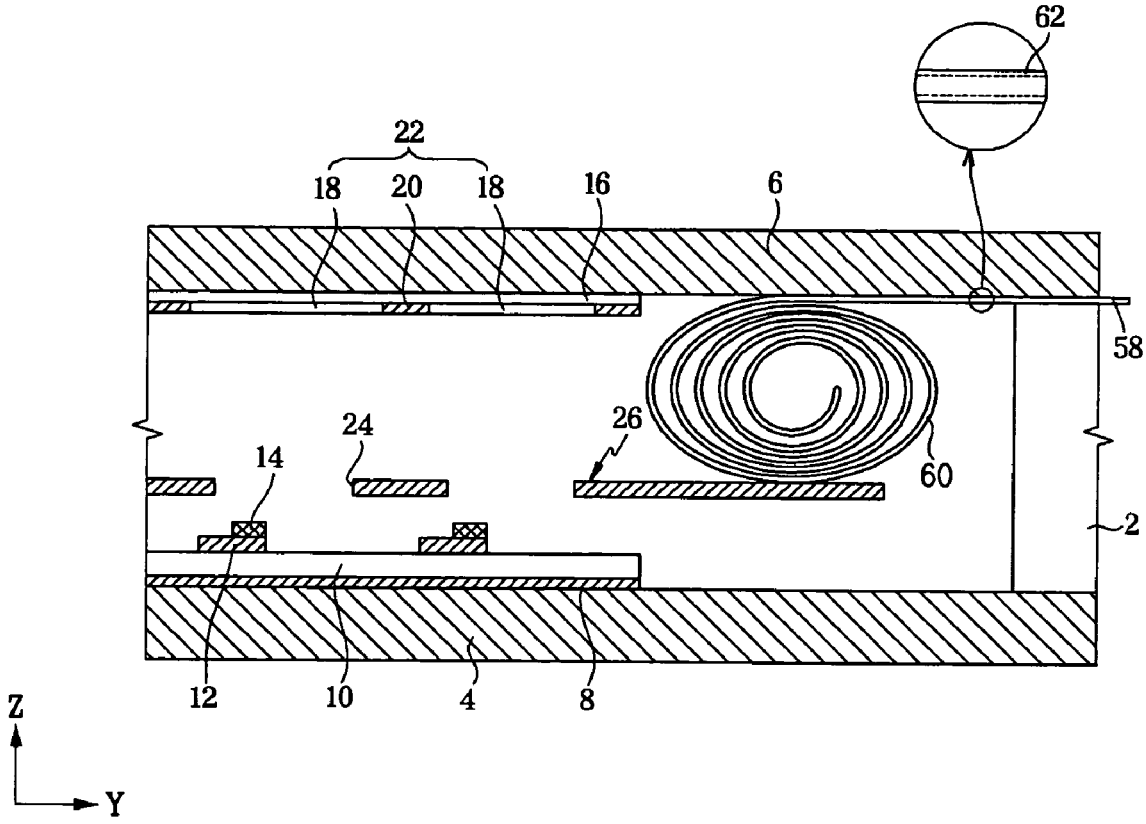
FIG. 11 is a partial sectional view of the flat panel display device according to an embodiment of the present invention in which another grid terminal is mounted at the grid electrode.

FIGS. 10 and 11 are partial sectional views of flat panel display devices according to still other embodiments of the present invention in which grid terminals are mounted at the grid electrode.

As shown in FIG. 10, the grid terminal 52 passes through the sealant 2 such that it contacts the grid electrode 26 at one end, and is exposed external to the sealant at its opposite end. In this embodiment, a spring-shaped variable length portion 54 is partially formed at the grid terminal 52 while being placed internal to the sealant 2 to permit thermal expansion and contraction of the grid electrode 26. In this structure, the variable length portion 54 is contracted when the grid electrode 26 is thermally expanded, and returns to its initial state when the grid electrode 26 is contracted, further helping to minimize any alignment errors in the grid electrode 26.

An insulating layer 56 is formed on the variable length portion 54 to prevent an electrical short circuit in the event the grid terminal 52 contacts the first substrate 4 or the second substrate 6.

As shown in FIG. 11, a spiral spring-shaped variable thickness spacer 60 can also be formed at the end portion of the grid terminal 58 contacting the grid electrode 26. When the first and the second substrates 4 and 6 are sealed to each other while the variable thickness portion 60 is placed on the grid electrode 26, the variable thickness portion 60 is pressed against the second substrate 6, and closely grips the grid electrode 26 so that the grid terminal 58 is held to the grid electrode 26.

As no welding is required to attach the grid terminal 58 to the grid electrode 26, the grid terminal 58 involves fewer manufacturing steps, and is effectively used in a device where the first and the second substrates 4 and 6 are closely spaced to one another. The grid terminal 58 does not affect the thermal expansion and the contraction of the grid electrode 26. That is, it does not induce any alignment error at the grid electrode 26. An insulating layer 62 is formed on the surface of the grid terminal 58 internal to the sealant 2 except for the variable thickness portion 60 to prevent an electrical short circuit if the grid terminal contacts either of the first substrate 4 or the second substrate 6.

Although preferred embodiments of the present invention have been described in detail hereinabove, it should be clearly understood that many variations and/or modifications of the basic inventive concept herein taught may be apparent to those skilled in the art, and will still fall within the spirit and scope of the present invention, as defined in the appended claims.

What is claimed is:

1. A flat panel display device comprising: first and second substrates facing each other and separated by a predetermined distance; a sealant sealing the first and the second substrates to one another; a plurality of electron emission sources arranged at the first substrate; a light emission unit arranged at the second substrate; and a grid electrode disposed between the first and the second substrates to control the focusing of the electrons, wherein the grid electrode comprises: a mask portion with apertures through which electrons may pass; and a plurality of fixtures arranged around the perimeter of the mask portion and defining a predetermined margin for allowing the thermal expansion of the mask portion, wherein each fixture comprises: a fixation frame externally attached to the mask portion; and a fixation piece penetrating the respective fixation frame and placed between the first and the second substrates, wherein the mask portion is generally of a rectangular shape defined by a rectangle with a pair of long sides and a pair of short sides, wherein the plurality of fixation frames comprise first and second frames provided at either end of each of the long sides of the rectangle and third frames provided midway along each of the long sides.

2. The flat panel display device of claim 1 wherein the fixation pieces placed within the respective fixation frames are spaced apart from the mask portion by a predetermined distance while forming a first gap in a direction of a short axis of the grid electrode.

3. The flat panel display device of claim 2 wherein each of the fixation pieces placed within the first and the second fixation frames has a lateral side directed toward one of the third fixation frames, and is spaced apart from the relevant fixation frame by a predetermined distance while forming a second gap in the direction of the long axis of the grid electrode.

4. The flat panel display device of claim 2 wherein the predetermined distance is a first predetermined distance and each of the fixation pieces placed within the third fixation frame has a pair of lateral sides with one lateral side directed toward the first fixation frame and the other lateral side directed toward the second fixation frame, and is spaced apart from the third fixation frame by a second predetermined distance while forming a third gap in the direction of the long axis of the grid electrode.

5. The flat panel display device of claim 2 wherein each of the fixation pieces placed within each of the third fixation frames has lateral sides directed toward the first and the second fixation frames while contacting the third fixation frame.

6. A flat panel display device comprising: first and second substrates facing each other and separated by a predetermined distance; a sealant sealing the first and the second substrates to one another; a plurality of electron emission sources arranged at the first substrate; a light emission unit arranged at the second substrate; and a grid electrode disposed between the first and the second substrates to control the focusing of the electrons, wherein the grid electrode comprises: a mask portion with apertures through which electrons may pass; and a plurality of fixtures arranged around the perimeter of the mask portion and defining a predetermined margin for allowing the thermal expansion of the mask portion, wherein each fixture comprises: a fixation frame externally attached to the mask portion; and a fixation piece penetrating the respective fixation frame and placed between the first and the second substrates, wherein the fixation pieces occupy 65-85% of the inner space area of the relevant fixation frame.

7. A flat panel display device comprising: first and second substrates facing each other and separated by a predetermined distance; a sealant sealing the first and the second substrates to one another; a plurality of electron emission sources arranged at the first substrate; a light emission unit arranged at the second substrate; and a grid electrode disposed between the first and the second substrates to control the focusing of the electrons, wherein the grid electrode comprises: a mask portion with apertures through which electrons may pass; and a plurality of fixtures arranged external to the mask portion with a predetermined margin for allowing the thermal expansion of the mask portion, wherein the grid electrode further comprises grid terminal passing through the sealant to apply electrical signals to the mask portion, the grid terminal having a variable length portion placed internal to the sealant with a predetermined elasticity.

8. The flat panel display device of claim 7 wherein the variable length portion is covered by an insulating layer.

9. A flat panel display device comprising: first and second substrates facing each other and separated by a predetermined distance; a sealant sealing the first and the second substrates to one another; a plurality of electron emission sources arranged at the first substrate; a light emission unit arranged at the second substrate; and a grid electrode disposed between the first and the second substrates to control the focusing of the electrons, wherein the grid electrode comprises: a mask portion with apertures through which electrons may pass; and a plurality of fixtures arranged external to the mask portion with a predetermined margin for allowing the thermal expansion of the mask portion, wherein the grid electrode further comprises a grid terminal passing through the sealant to apply electrical signals to the mask portion, the grid terminal having a variable thickness portion with a predetermined elasticity for contacting the mask portion.

10. The flat panel display device of claim 9 wherein a portion of the part of the grid terminal placed internal to the sealant is covered by an insulating layer.

* * * * *